US006511624B1

(12) United States Patent
Cho et al.

(10) Patent No.: US 6,511,624 B1
(45) Date of Patent: Jan. 28, 2003

(54) PROCESS FOR PREPARING INDUSTRIAL POLYESTER MULTIFILAMENT YARN

(75) Inventors: Eun-lai Cho, Seoul (KR); Duk-ho Oh, Ulsan (KR); Song-joo Choi, Ulsan (KR)

(73) Assignee: Hyosung Corporation, Seoul (KR)

( * ) Notice: Subject to any disclaimer, the term of this patent is extended or adjusted under 35 U.S.C. 154(b) by 0 days.

(21) Appl. No.: 10/032,569

(22) Filed: Jan. 2, 2002

(30) Foreign Application Priority Data

Oct. 31, 2001 (KR) ..... 01-67458
Dec. 20, 2001 (KR) ..... 01-81506

(51) Int. Cl.[7] ..... B29C 49/08; D01D 5/12; C08G 63/00

(52) U.S. Cl. ..... 264/210.7; 528/308.2; 528/308.3; 528/502; 528/503; 264/210.3; 264/210.8; 264/211; 264/211.14; 264/211.15; 264/237

(58) Field of Search ..... 528/308.2, 308.3, 528/502, 503; 264/210.3, 210.7, 210.8, 211, 211.14, 211.15, 237

(56) References Cited

U.S. PATENT DOCUMENTS 3,858,386 A 1/1975 Stofan
3,969,462 A 7/1976 Stofan
4,101,525 A 7/1978 Davis et al.
4,285,646 A 8/1981 Waite
4,414,169 A 11/1983 McClary
4,491,657 A 1/1985 Saito et al.
5,630,976 A * 5/1997 Nelson et al. ..... 264/210.8
5,866,055 A 2/1999 Schwarz et al.
6,015,616 A * 1/2000 Simons et al. ..... 428/364
6,403,006 B1 * 6/2002 Nelson et al. ..... 264/210.8

* cited by examiner

*Primary Examiner*—Samuel A. Acquah
(74) *Attorney, Agent, or Firm*—Greenblum & Bernstein, P.L.C.

(57) ABSTRACT

Disclosed is a process for preparing a high modulus and a low shrinkage polyester multifilament yarn of 1000 deniers or more at a spinning rate of 2,000 m/min or more, comprising the steps of: melt-extruding polyester chips having an intrinsic viscosity of 0.90 to 1.2 through a spinning nozzle and passing polyester chips through a heating zone; quenching melt-extruded yarns with the use of a radial in-to-out quenching method to solidify them; and providing spin finishes to solidified yarns before winding. The industrial polyester multifilament yarns have a coefficient of variation of 4.0% or less in a cross sectional diameter of filaments, and excellent uniformity of fineness. Treated cords formed from the industrial polyester multifilament yarns with high modulus and low shrinkage have an excellent dimensional stability and tenacity, and can be used as reinforcements of rubber goods such as tires.

6 Claims, 1 Drawing Sheet

PROCESS FOR PREPARING INDUSTRIAL POLYESTER MULTIFILAMENT YARN

BACKGROUND OF THE INVENTION

1. Field of the invention

The present invention relates, in general, to the process for preparing an industrial polyester multifilament yarn, and in particular, to a process for preparing an industrial polyester multifilament yarn with a high modulus and a low shrinkage, in which a treated cord produced from the polyester multifilament yarn has an excellent dimensional stability and tenacity, and can be applied to fiber reinforcements for use in rubber products such as a tire and an industrial belt or to other industrial applications.

2. Description of the Prior Art

High strength polyester fibers have been used in various applications such as a tire cord for reinforcing rubbers, a seat belt, a conveyer belt, a V-belt and a hose. Particularly, a treated cord converted through a latex and heat treatment for the use of a fiber reinforcement of tires requires an excellent dimensional stability and tenacity.

U.S. Pat. No. 4,101,525 (Davis et al.) and U.S. Pat. No. 4,491,657 (Saito et al.) disclose industrial polyester multifilament yarns having a high initial modulus and a low shrinkage. Since then, efforts have been made to produce high strength yarns at a faster spinning speed.

Generally, it is a well-known art in the industrial polyester high modulus low shrinkage yarn industry that the higher the spinning speed is, in the range of 2,000~3,200 m/min, while high intrinsic viscosity (I.V.)is used, within the preferred range of intrinsic viscosity(I.V.) 0.9~1.2, if the polymer & spinning temperature are the same, then the more the dimensional stability of treated cords and the strength retention of yarn to treated cord will be improved.

Theoretically, the dimensional stability of final treated cord and the strength retention to cord of the yarns can be increased by increasing a spinning tension of an industrial polyester yarn and increasing an orientation of undrawn yarns and a formation of a tie chain connecting crystals to each other. To produce higher strength treated cord, uniformity in the filament fineness and in the orientation level of undrawn yarn should be improved so that highly oriented undrawn yarns can be drawn at a high draw ratio.

In this perspective, improved polyester multifilament yarns with a high modulus and a low shrinkage can be produced by providing more uniform undrawn yarns under quick quenching (generally, the quicker the quenching is, the less uniform yarns are obtained)

According to U.S. Pat. No. 3,858,386 (Richard H. Stofan) and U.S. Pat. No. 3,969,462 (Richard H. Stofan), it is described that uniform undrawn yarns can be advantageously produced by a radial in to out quenching method, in view of evennees of yarn and a uniformity of tenacity and elongation. However, this radial in to out quenching method is only used to produce high strength polyester yarns at 1000 m/min or less.

According to U.S. Pat. No. 4,285,646 (Roland Waite), cooling gas is supplied through a spinning pack in a radial in to out flow quenching method, but this method is very difficult to carry out.

According to U.S. Pat. No. 4,414,169 (Edward B. McClary), a radial in to out quenching device is used, but the quenching device is unsuitable to be used to produce yarns for a polyester low shrinkage and high modulus tire cord yarn above 1000 deniers based on final drawn yarns, because the quenching device has a diameter of 1.5 inches and a length of 36 inches and a feed rate of cooling air is insufficient.

Furthermore, U.S. Pat. No. 5,866,055 (Raimund Schwarz et al.) discloses a process for producing an improved polyester multifilament yarn with a high modulus and a low shrinkage by use of a radial in to out quenching method.

According to this method, an uniform quick quenching is theoretically possible, however, high viscosity spin finish should be used in order that the spin finish oil would not be blown off because the spin finish oil is supplied to each filament directly below a radial in-to-out quenching device by a disk-type device for supplying the spin finish oil, and much damage ca be done to the spin filaments because the quenching of spun filaments becomes insufficient to contact yarns with the device for supplying spin finish oil near to the nozzle, in comparison with a conventional method in which yarns are contacted with the spin finish oil device near to take up roller.

Therefore, the process for producing an improved polyester multifilament yarn with a high modulus and a low shrinkage, which has a high spinning stress, by use of a high speed spinning method according to U.S. Pat. No. 5,866,055 has disadvantages in that it is difficult to produce heavy denier yarns above 1000 deniers at a high speed above 2000 m/min because the uniform of spin finish oil pick up and the uniformity of the stress applied to spun filaments are poor.

SUMMARY OF THE INVENTION

Therefore, it is an object of the present invention to provide a process for manufacturing an improved polyester multifilament yarn with a high modulus and a low shrinkage used in a production of a tire core, in which the heavy denier polyester multifilament yarn of 1000 deniers or more can be prepared by improving a uniform pick up of spin finishes and a uniformity of the tension among spinning filaments and using spin finishes with a relatively low viscosity, preferably aqueous emulsion spin finishes, with the use of a radial in-to-out quenching method at a spinning speed above 2,000 m/min. The radial in-to-out flow quenching method improves a quenching uniformity among filaments by blowing cooling air from inside to outside to a bundle of filaments below a spinning nozzle, by using a cylindrical device with a filter for blowing out cooling air.

Furthermore, the industrial heavy denier polyester multifilament yarn of 400 deniers or more produced at a spinning speed below 1,000 m/min according to the present invention is improved in the cross section CV% between filaments above 20% without effecting a big variation of the other physical properties.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
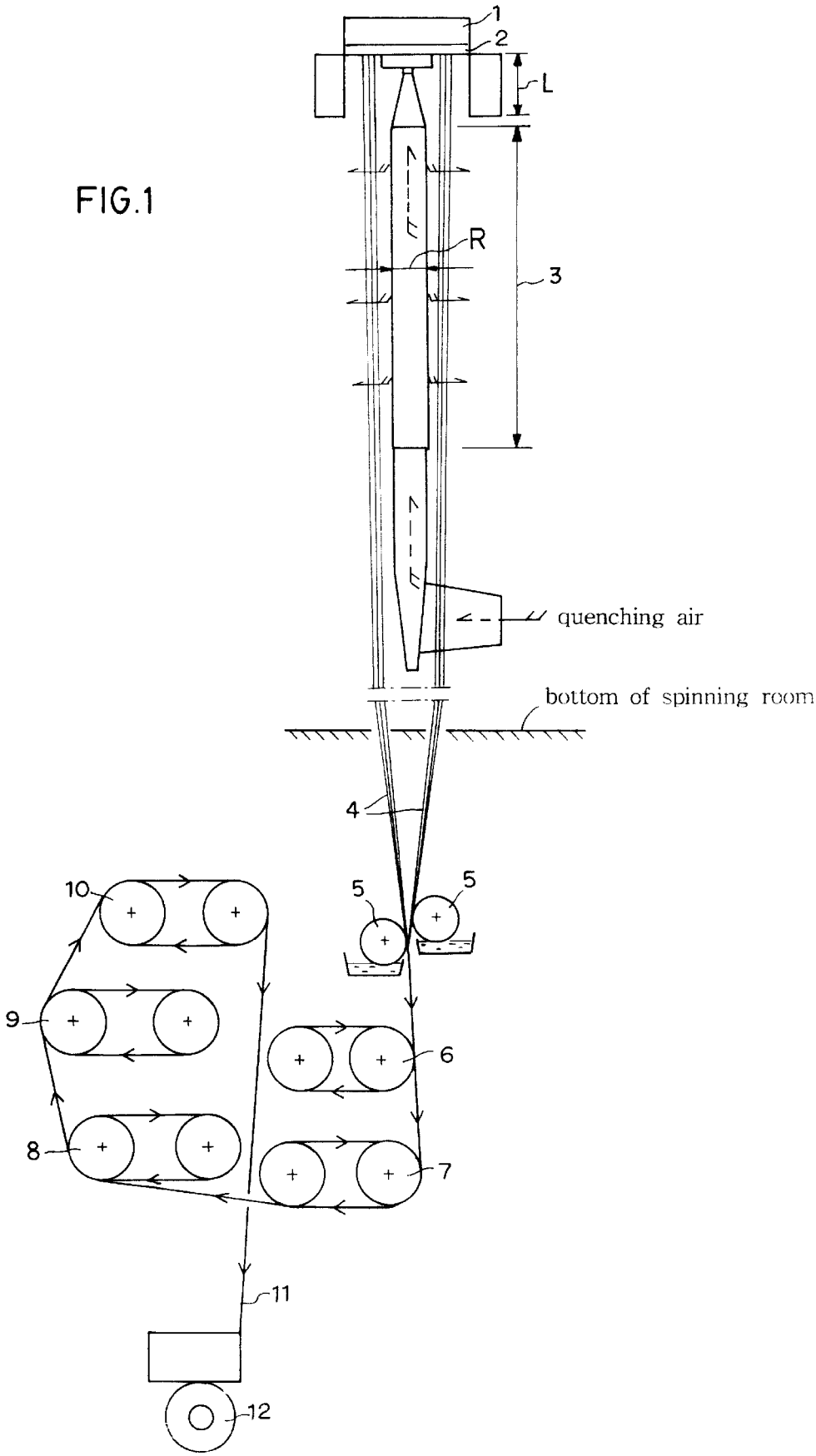
FIG. 1 schematically illustrates a process for preparing an industrial polyester multifilament yarn according to the present invention.

The present invention provides a process for preparing an industrial polyester multifilament yarn, comprising the steps of: A) extruding spun yarn having ethylene terephthalate units of 95 mol % or more and an intrinsic viscosity of 0.90 to 1.2 at 290 to 300° C. ; B) passing melt-extruded spun yarn through a hot zone, followed by quenching the resulting melt-spun yarn with the use of a radial in-to-out flow quenching method to solidify them; C) providing spin finish oil to yarns less than 2 m from an initial take up roller; D) taking up the undrawn yarn at 2,000 to 3,200 m/min so that a birefringence is 0.025 to 0.11 and a density is 1.338 to 1.375; and E) drawing the yarn at a total draw ratio of 1.5 to 2.5.

The polyester comprises ethylene terephthalate units of at least 95 mol %, preferably the ethylene terephthalate units of near to 100 mol %. Also, the polyester may comprise a small quantity of monomers derived from one or more diols or dicarboxylic acid as a unit of a copolymer, but not ethylene glycol and terephthalic acid or derivatives thereof.

According to the present invention, polyester chips with an intrinsic viscosity (I.V.) of 0.9 to 1.2 are melt-extruded and melt-spun through a spinning pack 1 and a nozzle 2 at 290 to 300° C. to prevent intrinsic viscosity(I.V.) drop from heat degradation and hydrolysis, in the step A. A fineness of the spun yarn is controlled so that the filament fineness of final drawn yarn is 2.5 to 6 deniers.

In the step B, melt-spun yarns 4 of the step A are quenched through a quenching zone 3. A short heating device, if required, may be set within a hood section, a length of which is situated from directly below a nozzle 2 to a starting point of a quenching zone 3. This hood section may be referred to as a delay quenching zone or a hot zone, and is 50 to 250 mm long. In addition, a temperature of the hood surface contacting with air ranges from 250 to 400° C.

A radial in to out quenching device is used in a quenching zone 3. A sectional diameter R of the quenching device is 12 cm or more, and its length is 60 to 100 cm, preferably 70 to 90 cm, and a temperature of cooling air ranges from 15 to 60° C., preferably from 15 to 40° C. A velocity of cooling air is 0.4 to 11.2 m/sec, preferably 0.8 to 1.0 m/sec at maximum.

A velocity distribution of cooling air is P type (the velocity is fast at an upper side, and slow at an lower side) or I type (velocities at an upper and lower sides are almost the same).

Spun yarn 4 should approach a radial in-to-out quenching device as closely as possible, but should not contact with the quenching device. Even if spun yarn 4 contact with the device, spinning tension level should not be affected.

Spin finish oil pick up becomes 0.5 to 1.0% based on spun yarn 4 by spin finish oil supplying device 5 according to a traditional oiling method such as a roller oiling or jet oiling method, in the step C.

According to the present invent ion, aqueous emulsion spin finishes are used.

In the step D, undrawn yarns are wound by a 1st drawing roller 6 at a spinning rate of 2000 to 3200 m/min, preferably 2300 to 3000 m/min so that undrawn yarns have a birefringence of 0.025 to 0.11 and a density of 1.338 to 1.375.

In the step E, yarns passing through the 1st drawing roller 6 are passed through a series of drawing rollers 7, 8, 9, and 10 at a total draw ratio of 1.5 to 2.5, preferably 1.7 to 2.3 to produce final drawn yarns 11 according to a spin draw method.

Final treated cords having improved high modulus and low shrinkage can be produced by narrowing a distance between a nozzle and an upper side of a quenching zone in the spinning process.

However, when a distance between a nozzle and a lower side of a heating device is below 50 mm (when a length of the heating device is 50 mm, the distance between the nozzle and the lower side of the heating device is 100 mm because a spinning block exists at a distance of 50 mm directly below the nozzle), or when a distance between the lower side of the heating device and an upper side of a radial in to out quenching device is beyond the range of 50~150 mm, final drawn yarns with preferable physical properties cannot be produced because undrawn yarns are non-uniform.

According to the present invention, the resulting polyester undrawn yarns have an intrinsic viscosity of 0.90 to 1.05, a birefringence of 0.025 to 0.11, and a density of 1.338 to 1.375 g/cm$^3$. Also, coefficients of variation in the birefringence and a cross section of the polyester undrawn yarn are superior to polyester undrawn yarn produced according to the conventional quenching method. In addition, the resulting drawn yarns c an be converted to the treated cord according to the traditional treatment.

For example, cord yarns are produced by plying and cabling drawn yarns of two strands of 1500 deniers in 390 twist/m (based on a general polyester treated cord). Then, the cord yarns are dipped into an adhesive liquid (isocyanate+epoxy or PCP resin+RFL (Resorcynol-Formalin-Latex)) in a 1st dipping tank, dried with a stretch of 1.0 to 4.0% at 130 to 160° C. for 150 to 200 sec in a drying zone, heat set with a stretch of 2.0 to 6.0% at 235 to 245° C. for 45 to 80 sec in a hot stretching zone, dipped into an adhesive liquid (RFL) in a 2nd dipping tank, dried at 140 to 160° C. for 90 to 120 sec, and heat set with a stretch of −4.0 to 2.0% at 235 to 245° C. for 45 to 80 sec to produce dipping treated cords.

The resulting treated cords (produced by plying and cabling drawn yarns of two strands of 1500 deniers in 390 tpm) have $E_{2.25}$+FS of 6.0 to 7.7% and a tenacity of 6.7 to 7.2 g/d ($E_{2.25}$: elongation at 2.25 g/d, FS: free shrinkage).

As described above, the treated cords produced from polyester multifilament yarns with a high modulus and a low shrinkage of the present invention have an excellent dimensional stability and a tenacity, and can be applied to a reinforcement for use in rubber products such as a tire and an industrial belt or other industrial applications.

EXAMPLE AND COMPARATIVE EXAMPLE

A better understanding of the present invention may be obtained in light of the following examples which are set forth to illustrate, but are not to be construed to limit the present invention.

Physical properties of multifilament yarns and treated cords according to examples and comparative examples of the present invention are estimated as follows:

(1) Intrinsic viscosity (I.V.)

0.1 g of a sample was dissolved in an agent containing phenol and 1,1,2,3-tetrachloroethane at a weight ratio of 6:4 at 90° C. for 90 min, such that a concentration of the resulting mixture was 0.4 g/100 ml) and then the resulting mixture was charged into an Ubbelohde viscometer and maintained in a thermostat at 30° C. for 10 min. After that, drops per seconds of the resulting solution and a solvent, respectively, were measured with the use of the viscometer and an aspirator. Next, R.V. and I.V. were calculated with the use of following equations 1 and 2, respectively.

$$R.V. = \text{a drops per second of a sample/a drops per second of a solvent} \quad \text{Equation 1}$$

$$I.V. = 1/4 \times [(R.V. - 1)/C] + 3/4 \times (\ln R.V./C) \quad \text{Equation 2}$$

wherein, C is a concentration of a sample in a solution (g/100 ml)

(2) Strength and Elongation

Strength and elongation of the sample with a length of 250 mm were measured under a standard state (20° C., relative humidity of 65%) according to ASTM D 885 with the use of Instron 5565 (Instron, USA) at a tension speed of 300 mm/min and at 80 turns/m.

(3) Density and Crystallinity

A density was measured with the use of a xylene/carbon tetrachloride density column at 23° C. The density column had a density of 1.34 to 1.41 g/m$^3$, and was produced according to ASTM D 1505.

$$\text{Crystallinity } (\%)=\rho c/p\times(\rho-\rho a)/(\rho c-\rho a) \qquad \text{Equation 3}$$

wherein, ρis a density of a sample (g/cm$^3$), ρc and ρa are densities of a crystal (1.455 g/cm$^3$) and an amorphous (1.335 g/cm$^3$), respectively.

(4) Birefringence

A birefringence was measured by a polarized microscope with a Berek compensator, by the following procedure:

A polarizer and an analyzer were positioned at right angles to each other (orthogonal polarization); A compensator was inserted into the polarized microscope in such a way that the compensator met the analyzer at an angle of 45°(an angle of 45° to the N-S direction of a microscope).

A sample was put on a stage at a diagonal position ($n_v$-direction: the polarizer met the sample at an angle of 45°) —a black compensation band was observed at this position. A scale was read at a position at which a center of the sample was darkest while a micrometer screw of the compensator revolved to the right.

The scale was read again at the position, at which the center of the sample was darkest while the micrometer screw of the compensator revolved to the left.

A difference between the above two scales was divided by 2 to produce a slope angle, and a retardation (v, nm) was obtained from the slope angle with reference to a reference table supplied by the manufacturer.

$$i=(a-b)/2$$

wherein, i=slope angle once >90°: a once <90°: b

The compensator and the analyzer were removed, and then a thickness (d, nm) of the sample was measured with the use of an eyefilar micrometer.

A birefringence (Δn) was calculated by substituting the retardation and the thickness values into the following equation $$\Delta n=v/d$$

(5) Shrinkage

A sample was left at a temperature of 20° C. and a relative humidity of 65% under a standard state for 24 hours or more, and then a length ($L_o$) of the sample was measured, which had a weight corresponding to 0.05 g/d. After that, the sample was treated under a tensionless state at 150° C. for 30 min with the use of a dry oven, followed by being left for 4 hours or more after the sample was removed from the dry oven. The length (L) of the resulting sample was measured, which had the weight corresponding to 0.05 g/d, thereby the shrinkage was calculated by equation 4, below.

$$\Delta S\%=(L_{o-L})/L_o\times 100$$

(6) Middle elongation

As for a yarn on a strength and elongation S—S curve, an elongation was measured at a load of 4.5 g/d and a treated cord was measured at a load of 2.25 g/d.

(7) Dimensional stability

A dimensional stability of the treated cord, which is physical property related with a side wall indentation (SWI) and a handling of tires, was defined as a modulus in a given shrinkage. $E_{2.25}$(elongation at 2.25 g/d)+FS (free shrinkage) was a degree of the dimensional stabilities of treated cords in different heat treatment processes, and the lower $E_{2.25}$+FS was, the better the dimensional stability was.

EXAMPLE 1

Solid phase polymerized polyethylene terephthalate chips with an intrinsic viscosity of 1.10 and a moisture regain of 20 ppm were produced in a presence of a polymerization catalyst, i.e. antimony compound, which was present in an amount of 220 ppm as the antimony metal in the polymer. Polyethylene terephthalate chips were melt-spun at 900 g/min and 292° C. with the use of a extruder so that a monofilament fineness of the final drawn yarn was 3.5 deniers.

Then, spun yarns were passed through a heating hood with a length of 100 mm directly below the nozzle and a radial in to out quenching zone with a length of 800 mm, in which air of 20° C. circulates at a rate of 0.5 m/sec, to be solidified. Thereafter, solidified spun yarns were oiled with aqueous spin finishes at a position 1 m from a wind-up roller 12, wound at 2700 m/min to produce undrawn yarns, drawn through three phases at a total draw ratio of 1.98, heat-set at 230° C., and relaxed by 2.0%, and finally wound to produce final drawn yarns of 1500 deniers.

Cord yarns were produced by plying and cabling the resulting drawn yarns of two strands in 390 twist/m. The cord yarns were dipped into an adhesive liquid (isocyanate+epoxy or PCP resin+RFL) in a 1st dipping tank, dried with a stretch of 3.0% at 150° C. for 180 sec in a drying zone, heat set with a stretch of 4.0% at 240° C. for 60 sec in a hot stretching zone, dipped into an adhesive liquid (RFL) in a 2nd dipping tank, dried at 150° C. for 110 sec, and heat set with a stretch of −1.0% at 240° C. for 60 sec to produce dipping treated cords.

Physical properties of undrawn yarns, drawn yarns, and treated cords were estimated, and the results are described in Tables 1—1 and 1–2.

TABLE 1-1

| | Exam. 1 |
|---|---|
| I.V. of the chip (I.V.) | 1.10 |
| Temp. of spinning beam (° C.) | 292 |
| I.V. of undrawn yarn (I.V.) | 0.96 |
| Monofilament fine. (de.) | 3.5 |
| Heating hood | |
| Length (mm) | 100 |
| Temp. (° C.) | 330 |
| [1]A length from the hood to the quenching device (mm) | 80 |
| Radial in to out Quenching | |
| Diameter of cross section (mm) | 180 |
| Length (mm) | 800 |
| Air velocity (m/sec) | 0.6 |
| Spinning speed (m/min) | 2700 |
| Undrawn yary | |
| Birefringence | 0.07 |
| Density (g/cm$^3$) | 1.357 |
| Cystallinity | 10.7 |

[1]A length from the lower side of the heating hood to the upper side of the quenching device

TABLE 1-2

| | Exam. 1 |
|---|---|
| Total draw ratio | 1.98 |
| Drawn yarn | |
| Intrinsic viscosity | 0.935 |
| Tenacity (g/d) | 8.0 |
| Middle elongation (%) | 5.5 |
| Elongation (%) | 13.2 |
| Shrinkage (%) | 4.5 |
| Monofilament fineness (d) | 3.5 |
| Monofilament CV (%) | 3.1 |
| O.P.U. (%) | 0.7 |
| Dipped cord | |
| Tenacity (g/d) | 6.8 |
| Middle elongation (%) | 4.0 |
| Shrinkage (%) | 2.4 |
| E + S (%) | 6.4 |

EXAMPLES 2 TO 4 AND COMPARATIVE EXAMPLES 1 TO 8

The procedure of example 1 was repeated except that a temperature and length of a heating hood, a distance between a lower side of the heating hood and a upper side of a quenching device, a diameter of the quenching device, a length and cooling air velocity of a quenching zone, a spinning speed, a fineness and a total draw ratio were varied as described in Tables 2 and 3. The final drawn yarns and treated cord were produced by properly controlling a spinning amount according to a fineness of final drawn yarns, and physical properties of drawn yarns and treated cords are described in Table 3.

COMPARATIVE EXAMPLES 9 TO 10

The procedure of example 1 was repeated except that a temperature and length of a heating hood, a distance between a lower side of the heating hood and a upper side of a quenching device, a diameter of the quenching device, a length and cooling air velocity of a quenching zone, a spinning speed, a fineness and a total draw ratio were varied as described in Tables 2 and 3. The final drawn yarns and treated cords were produced according to a method for endowing spin finishes of a prior art, i.e. FIG. 1 in U.S. Pat. No. 5,866,055, in which raw liquid-type oiling agents having a similar physical properties and operating efficiency to an oiling agent of the present invention are added to spun yarns with the use of a disk-type device for endowing an oiling agent at 0.5 and 1 m directly below a radial in to out flow quenching device so that an amount of adhered oiling agent is 0.5 to 1.0 wt%, and physical properties of final drawn yarns and treated cords are described in Table 3.

TABLE 2

| | | C.1 | C.2 | C.3 | C.4 | C.5 | E.2 | E.3 |
|---|---|---|---|---|---|---|---|---|
| I.V. of chip | | 0.95 | 1.10 | 1.10 | 1.10 | 1.10 | 1.10 | 1.10 |
| Temp. of spinning beam (° C.) | | 290 | 293 | 293 | 293 | 293 | 293 | 293 |
| I.V. of undrawn yarn | | 0.88 | 0.94 | 0.96 | 0.95 | 0.95 | 0.96 | 0.96 |
| [1]Fin. (denier) | | 3.5 | 3.5 | 3.5 | 3.5 | 3.5 | 3.5 | 3.5 |
| Hood | Length (mm) | 100 | 100 | 100 | 250 | 250 | 130 | 100 |
| | Temp. (° C.) | 330 | 330 | 330 | 330 | 330 | 330 | 350 |
| [2]Length (mm) | | 80 | 80 | 80 | 80 | 30 | 60 | 100 |
| [5]Quench. | [3]Dia. (mm) | 180 | 180 | 100 | 180 | 180 | 180 | 180 |
| | Length (mm) | 800 | 800 | 800 | 500 | 500 | 800 | 800 |
| | [4]Air (m/s) | 0.6 | 0.6 | 0.6 | 0.6 | 0.6 | 0.6 | 0.8 |
| Spinning speed (m/min) | | 2700 | 1800 | 2700 | 2700 | 2700 | 2700 | 2600 |
| Undrawn yarn | [6]Bir. | 0.045 | 0.020 | 0.060 | 0.063 | 0.065 | 0.065 | 0.068 |
| | Density (g/cm$^2$) | 1.340 | 1.337 | 1.351 | 1.353 | 1.355 | 1.357 | 1.357 |

| | | C.6 | C.7 | C.8 | E.4 | C.9 | C.10 |
|---|---|---|---|---|---|---|---|
| I.V. of chip | | 1.10 | 1.10 | 1.10 | 1.10 | 1.10 | 1.10 |
| Temp. of spinning beam (° C.) | | 293 | 293 | 293 | 293 | 293 | 293 |
| I.V. of undrawn yarn | | 0.96 | 0.96 | 0.97 | 0.96 | 0.96 | 0.96 |
| [1]Fin. (denier) | | 3.5 | 3.5 | 3.5 | 3.5 | 3.5 | 3.5 |
| Hood | Length (mm) | 100 | 100 | 100 | 100 | 100 | 100 |
| | Temp. (° C.) | 350 | 350 | 350 | 350 | 350 | 350 |
| [2]Length (mm) | | 200 | 100 | 80 | 60 | 80 | 80 |
| [5]Quench. | [3]Dia. (mm) | 180 | 180 | 180 | 200 | 180 | 180 |
| | Length (mm) | 800 | 800 | 800 | 800 | 800 | 800 |
| | [6]Air (m/s) | 0.8 | 0.3 | 0.5 | 0.8 | 0.6 | 0.6 |

TABLE 2-continued

| | | | | | | | |
|---|---|---|---|---|---|---|---|
| | Spinning speed (m/min) | 2600 | 2600 | 3300 | 2600 | 2600 | 3000 |
| Undrawn yarn | [6]Bir. | 0.068 | 0.062 | 0.120 | 0.070 | 0.060 | 0.080 |
| | Density (g/cm$^2$) | 1.356 | 1.352 | 1.378 | 1.360 | 1.358 | 1.360 |

[1]Monofilament fineness
[2]A length from the lower side of the heating hood to the upper side of the quenching device
[3]Diameter of cross section
[4]Air velocity
[5]Radial in to out quenching
[6]Birefringence

TABLE 3

| | | C.1 | C.2 | C.3 | C.4 | C.5 | E.2 | E.3 | C.6 | C.7 | C.8 | E.4 | C.9 | C.10 |
|---|---|---|---|---|---|---|---|---|---|---|---|---|---|---|
| [1]Draw ratio | | 1.95 | 2.30 | 1.96 | 1.97 | 1.95 | 1.99 | 1.98 | 1.95 | 1.95 | 1.85 | 1.98 | 1.95 | 1.85 |
| [3]Dra. yarn | I.V. | 0.87 | 0.93 | 0.94 | 0.94 | 0.94 | 0.945 | 0.945 | 0.945 | 0.945 | 0.955 | 0.945 | 0.945 | 0.945 |
| | Tenac. (g/d) | 8.0 | 8.0 | 7.6 | 7.8 | 7.3 | 8.0 | 8.0 | 7.8 | 7.8 | 7.3 | 8.0 | 7.8 | 7.5 |
| | Middle elong. (%) | 5.6 | 5.6 | 5.6 | 5.5 | 5.8 | 5.5 | 5.5 | 5.5 | 5.5 | 4.0 | 4.5 | 4.5 | 4.5 |
| | Elong. (%) | 12.0 | 13.5 | 12.5 | 13.0 | 14.0 | 13.5 | 13.2 | 13.0 | 13.3 | 15.5 | 13.0 | 13.0 | 13.0 |
| | Shrink. (%) | 6.2 | 7.5 | 5.2 | 5.0 | 4.8 | 4.7 | 4.5 | 5.0 | 7.5 | 4.1 | 4.5 | 6.0 | 6.0 |
| | filament fin. (d) | 3.5 | 3.5 | 3.5 | 3.5 | 3.5 | 3.5 | 3.5 | 3.5 | 3.5 | 3.5 | 3.5 | 3.5 | 3.5 |
| | Filament CV (%) | 3.6 | 3.8 | 6.8 | 5.1 | 8.7 | 3.8 | 3.8 | 5.8 | 5.2 | 3.4 | 3.7 | 8.5 | 5.5 |
| | O.P.U. (%) | 0.7 | 0.7 | 0.7 | 0.7 | 0.7 | 0.7 | 0.7 | 0.7 | 0.7 | 0.7 | 0.7 | 0.5 | 0.5 |
| [4]Dip. cord | [2]Tena. (g/d) | 6.5 | 6.5 | 6.5 | 6.8 | | 6.8 | 6.8 | 6.8 | 6.8 | 6.2 | 6.8 | 6.4 | 6.6 |
| | Middle elong. (%) | 4.5 | 4.5 | 4.3 | 4.2 | | 4.1 | 4.1 | 4.5 | 4.5 | 4.5 | 4.0 | 4.0 | 4.0 |
| | Shrink. (%) | 3.0 | 4.5 | 2.8 | 2.5 | | 2.4 | 2.5 | 2.5 | 3.5 | 2.2 | 2.3 | 4.0 | 3.2 |
| | E + S (%) | 7.5 | 9.0 | 7.1 | 6.8 | | 6.5 | 6.6 | 7.0 | 8.0 | 6.7 | 6.3 | 8.0 | 7.2 |
| | | | | | | XX | | | X | X | X | | X | |

* X : bad appearance
* XX : worst appearance (No dip test)
[1]Total draw ratio is determined as 97% of the draw ratio obtained in the yarn wound for 5 min
[2]Tena.: Tenacity
[3]Dra. Yarn: Drawn yarn
[4]Dip. Cord: Dipped cord As described above, the present invention provides a process for preparing an industrial polyester multifilament yarn with a tenacity of 7.8 g/d or more and shrinkage of 4.7% or less. The polyester multifilament yarn having a high modulus and a low shrinkage provides treated cords with a high dimensional stability and tenacity, and can applied to various applications, such as a tire and an industrial belt.

It should also be understood that the foregoing relates to only the scope of the invention is defined by the appended claims rather than by the description preceding them, and all changes that fall within meets and bounds of the claims, or equivalence of such meets and bounds are therefore intended to be embraced by the claims.

The present disclosure relates to subject matter contained in priority Korean Patent Application Nos. 2001-67458, filed on Oct. 31, 2001, and 2001-81506, filed on Dec. 20, 2001, the contents of both of which are herein expressly incorporated by reference in their entireties.

What is claimed is:

1. A process for preparing an industrial polyester multifilament yarn, comprising the steps of:

A) melt-extruding a polyester polymer having ethylene terephthalate units of 90 mol % or more and an intrinsic viscosity of 0.90 to 1.2 to produce extruded yarn;

B) quenching extruded yarns through a quenching zone with the use of a radial in to out flow quenching method to solidify them;

C) providing spin finish oil to solidified yarns less than 2 m from an initial wind-up roller;

D) taking up the resulting yarn at 2,000 to 3,200 m/min so that a birefringence is 0.025 to 0.11 and a density is 1.338 to 1.375;

E) drawing wound yarns at total draw ratio of 1.5 to 2.5 to produce drawn yarn.

2. The process according to claim 1, wherein solidified -yarns are oiled with the use of an aqueous emulsion.

3. The process according to claim 1, wherein the radial in-to-out flow quenching method is used under the following conditions:

(1) a quenching device with a sectional diameter of 12 cm or more;

(2) a quenching zone with a length of 60 cm or more; (3) cooling air of 15~60° C.; and (4) cooling air flow rate of 0.4 to 1.2 m/sec.

4. The process according to claim 1, wherein drawn yarns have a tenacity of at least 7.8 g/d, a shrinkage of 4.7% or less, and a sectional CV % of filaments of 4.0% or less.

5. The process according to claim 1, wherein drawn yarns have a monofilament fineness of 2.5 to 6 deniers and a total fineness of 1,000 deniers or more.

6. A treated cord, prepared from the industrial polyester multifilament yarn of claim 1 by treatment with resorcinol-formalin-latex, having a dimensional stability of 6 to 7.7% as represented by $E_{2.25}$+FS wherein $E_{2.25}$ means elongation at 2.25 g/d and FS means free shrinkage, and a tenacity of 6.7 to 7.2 g/d.

* * * * *